United States Patent [19]

Steadman

[11] 3,974,938

[45] Aug. 17, 1976

[54] TAMPER-PROOF SEALS

[75] Inventor: Brian Lee Steadman, Alcester, England

[73] Assignee: Avon Medicals Limited, Melksham, England

[22] Filed: Nov. 13, 1975

[21] Appl. No.: 631,475

[30] Foreign Application Priority Data

Nov. 18, 1974 United Kingdom ..... 49836/74

[52] U.S. Cl. ..... 220/266; 220/375; 150/.5; 222/541; 215/306; 215/250

[51] Int. Cl.[2] ..... B65D 41/32

[58] Field of Search ..... 220/266, 270, 276, 375; 215/306, 250; 150/.5; 222/541, 153

[56] References Cited

UNITED STATES PATENTS

| | | | |
|---|---|---|---|
| 2,964,945 | 12/1960 | Walkowiak | 73/322 |
| 3,199,748 | 8/1965 | Bross | 220/266 X |
| 3,282,477 | 1/1961 | Henchert | 220/375 X |
| 3,330,439 | 7/1967 | Moorman | 220/63 R |
| 3,608,771 | 9/1971 | Monroe et al. | 220/266 |
| 3,648,886 | 3/1972 | Pringle | 220/85 B |
| 3,710,612 | 1/1973 | Innes | 73/322.5 |
| 3,858,739 | 1/1975 | Turner et al. | 220/266 X |
| 3,912,107 | 10/1975 | Baumann | 220/63 R |

FOREIGN PATENTS OR APPLICATIONS

| | | | |
|---|---|---|---|
| 334,569 | 7/1934 | Germany | 73/317 |

*Primary Examiner*—George T. Hall
*Attorney, Agent, or Firm*—Watson Leavenworth Kelton & Taggart

[57] ABSTRACT

A seal in or for a blood bag has a first tamperproof seal consisting of a tube with an end wall separated by a line of weakening from an access passage. The line of weakening is torn open to gain access to the passage. The end wall is attached also by a flexible strap, and the action of tearing the line of weakening open renders available a plug also borne by the strap. Resealing by this plug is also tamper-proof in the sense that the plug cannot be removed without evidence that removal has been done or attempted.

12 Claims, 10 Drawing Figures

TAMPER-PROOF SEALS

FIELD OF THE INVENTION

The present invention relates to tamper-proof seals and particularly to tamper-proof seals for items of medical or research equipment, and to items equipped with such seals. We have in mind particularly the tamper-proof sealing of blood bags i.e., the receptacles in which blood or blood products are received or stored, in which they may be treated and from which they are ultimately withdrawn.

BACKGROUND OF THE INVENTION

It is a common requirement of medical services that use blood bags that the seals through which access is to be had to the bag for the purpose of using the contents of the bag shall be tamper-proof. That is to say once the seal has been broken it either is incapable of reclosing or else there is an obvious signal that it has been broken. This ensures that when the contents of the bag are used it can be ascertained that they have not been adulterated, infected or substituted.

It is customary never to withdraw all the blood or blood products from the bag since it is a routine precaution to retain some in the bag for analysis in the event that anything untoward happens to the patient. There might be a suspicion of mis-matching of blood groups, for example. For this purpose some bags are equipped with, as well as the tamper-proof initial seal, a replaceable cap which prevents leakage of the remaining content or air access to the remaining contents and which is placed over the access orifice at which the tamper-proof seal was originally present. These caps have usually been readily removable and the situation could be envisaged of fraudulent tampering with the remaining contents of the bag if it was known that an enquiry was likely; or of inadvertent removal of the cap with contamination or loss of those remaining contents.

SUMMARY OF THE INVENTION

To avoid this, the present invention provides a tamper-proof seal which consists of two such seals adapted to be used one after the other on the same position of access to a container and each adapted to show, respectively, that when they are intact they cannot have been broken.

According to the invention we provide a tamper-proof seal for an access opening, including a tamper-proof seal for an access opening, including a first tamper-proof seal denying access to said opening until it has been destroyed and a second access-denying means to re-seal and deny access to the access opening made available on the destruction of the first seal, the second access-denying means being arranged to indicate when it has been thereafter disturbed from its access-denying position, as well as a container so equipped. In a preferred embodiment the first tamper-proof seal is a line of weakening around a sealed tube having at one axial side of the line of weakening an access passage and at the other end a portion blanked off by an end wall whereby tearing off of the tube at the line of opening exposes the access passage for use, and the blanked off portion is attached by a strap to the portion providing the access passage, the strap bearing additionally an obturator for the access passage thus exposed, the strap and the obturator being attached to each other through a frangible link whereby after the obturator has been placed to deny access to the access passage an attempt to remove the obturator will cause rupture of the frangible link between the strap and the obturator. It is further preferred that the strap shall be, attached at one side of the portion providing the access passage and passed through 360° over the blanked off portion to be attached to a side of the blanked-off portion opposite the side of the access portion to which it was attached, the obturator being provided adjacent the end wall and at an axial face of it opposite to the axial face which blanks off the blanked-off portion at one axial side of the first tamper-proof seal, whereby the strap in unrolling after destruction of the first seal offers the obturator for presentation to the access passage.

DESCRIPTION OF THE DRAWINGS AND OF A PARTICULAR EMBODIMENT

A particular embodiment of the invention will now be described with reference to the accompanying drawings wherein.

Figure 1:
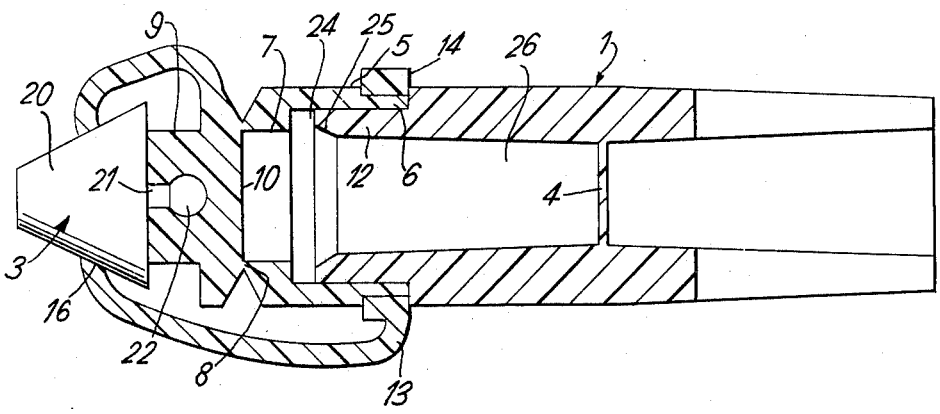
FIG. 1 is a diametrical section through the embodiment.

The embodiment seen in these Figures is made up of three separately formed parts given the general reference numbers 1,2 and 3.

Part 1 is a tube moulded in P.V.C. with a thick generally cylindrical wall and a rupturable diaphragm 4 across it approximately half-way along its length. This part 1 is to be secured to a container such as a blood bag so as to form an access passage 26, i.e., an inlet or outlet passage to that bag. The diaphragm forms a seal against contamination but is not in itself to be regarded as a tamper-proof seal. The parts 2 and 3 together provide two tamper-proof seals usable one after the other.

Figure 2:
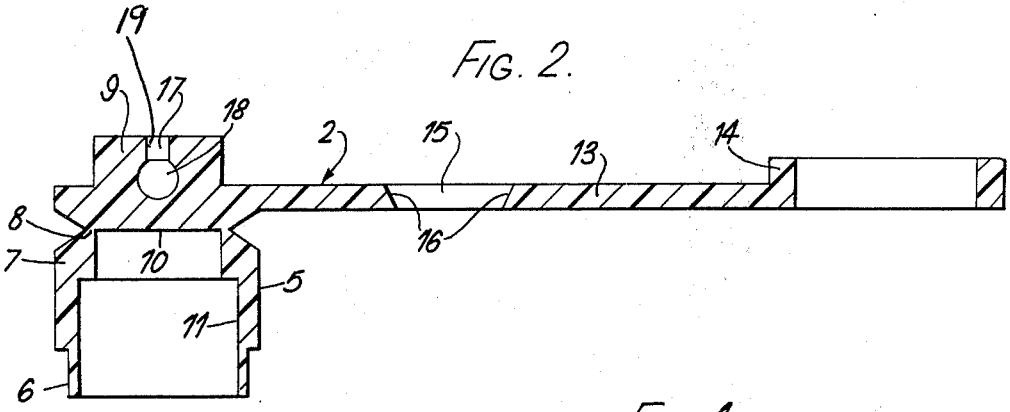
FIG. 2 is a diametrical section through one part thereof.

The part 2, seen by itself in FIG. 2 is an integral moulding of P.V.C. It has a skirt 5 with a rebate 6 at one end and at the other end an internal shoulder 7. The skirt is joined by a narrow neck 8 of material to a second portion of the part 2 which portion includes block 9 which provides a wall 10 which blanks off a passage defined by internal shoulder 7 and the skirt 5. The inner diameter of the skirt 5 i.e., the diameter of its wall 11 below the shoulder 7 is the same as the external diameter of an end portion 12 of the part 1 so that the latter may be inserted with a close fit into the former and be secured there by for example the use of a solvent for the material of the two parts. The extreme end of the end portion 12 does not reach as far as the shoulder portion 7 and leaves a passage portion 24 of greater diameter than the rest of the passage and which is defined by the inner wall of the skirt 5. The inner periphery of the extreme end of the end portion 12 is chamfered as at 25. At one diameter of the block 9 there is integrally formed a strap 13 which has at one end a ring 14 of which the internal diameter is the same as the external diameter of the rebate 6 of the skirt 5. In the strap and between the ring 14 and the block 9 in an aperture 15 of which the walls may be tapered as shown at 16.

Formed in the block 9 is an undercut recess 17 having in this example a part-spherical innermost end portion 18 and a cylindrical entry passage 19 of a diameter less than the diameter of the part-spherical portion. The part 2 also has integrally moulded with it and at right angles to the strap 13, a lift tab 23 (FIGS. 3 to 8).

The third part, 3, is plainly seen from FIG. 1 and consists of a frusto-conical head 20 and a stem of which the dimensions are shaped in counterpart to the undercut recess 17, having a narrow shank 21 to fit within the entry passage 19 and an enlarged part spherical head 22 to fit within the part-spherical portion 18. The part 3 is destined to be forced through the passage defined by the shoulder portion 7 of the part 2 but has however a large end of a maximum diameter considerably greater than the inner diameter of the shoulder portion 7 and somewhat greater than that of the passage portion 24, so this large end will lodge under the annular flange of the shoulder portion 7 and in the passage portion 24, and cause some expansive distortion of the material of the skirt 5. The stem of the part 3 is a tight snap fit within the undercut recess 17.

The preferred material for parts 1 and 2 is P.V.C. since this is readily moulded, can easily be adhered to itself and is easily sterilisable, whereas the material of the part 3 is preferably harder and more brittle than P.V.C. such as for example Nylon or Diakon.

Figure 3:
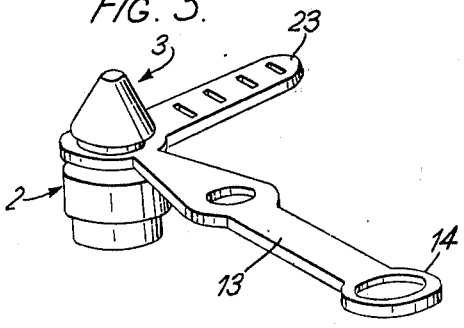
FIGS. 3 to 8 are perspective views showing the assembly and manner of use of the embodiment.
Figure 4:
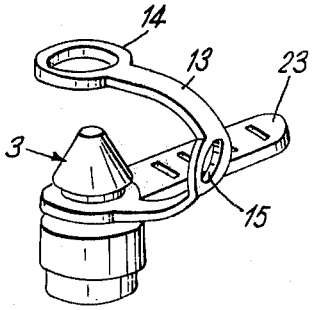
Figure 5:
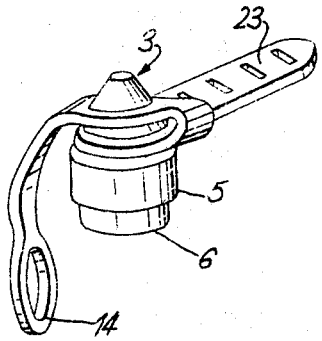
Figure 6:
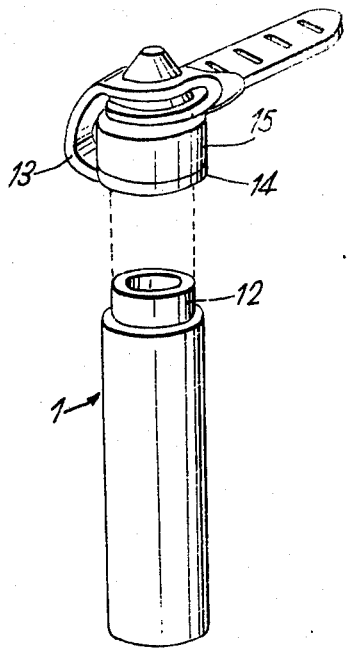

The manner of assembly and use of the embodiment is now described with reference to the remaining figures. In FIG. 3 the part 2 is shown in a condition analogous to that seen in FIG. 2 but with part 3 fitted to it by snap fitting of the shank parts 21,22 into the recess 17 in the block 9. The taper of the part 3 is such that it diminishes in diameter the further one goes away from the blank wall 10 or the skirt 5 of the part 2. FIG. 3 shows also lift tab 23 for use as will be described. To assemble the seal, the strap is brought round 360° as shown in sequence by FIGS. 3,4,5 and 6 so that the aperture 15 comes over the head of the part 3 (FIG. 5) and the ring 14 is brought to fit around the rebate 6 of the bottom of the skirt 5. Thus the strap bends through 360°, projecting at one diameter from the part 2 at the level of the ring 14 and projecting from the opposite diameter of the part 2 at the level of the block 9.

Figure 7:
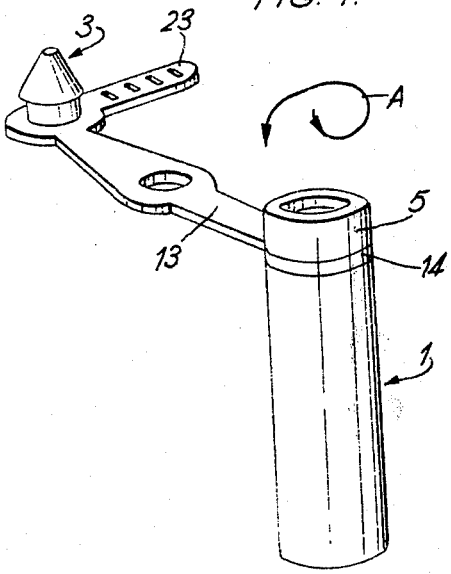
Figure 8:
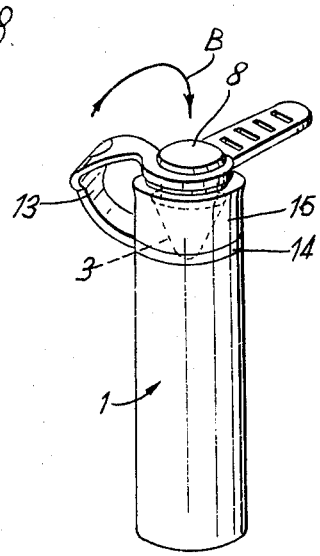
Figure 9:
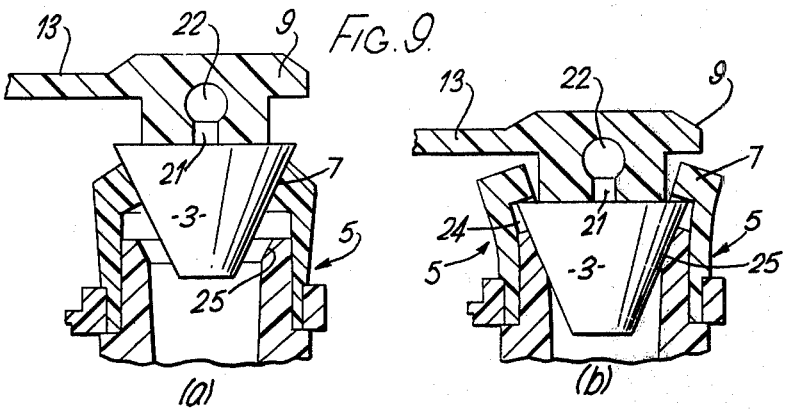
FIGS. 9*a* and 9*b* are partial sections analogous to FIG. 1 showing stages of use and FIG. 10 is a diagrammatic drawing of a blood bag equipped with such a seal.

Then, the part 1 is brought up so that its end 12 is fitted and secured within the skirt 5 of the part 2. Thus a passage is defined by shoulder 7, skirt 5 and part 1 which is blocked off by the blank wall 10 at one end. At the other end it passes into the container such as the blood bag to which the seal is then secured. To gain access to this passage the lift tag 23 is lifted upwardly to break the part 2 at the line of weakening 8 so that access is had to the passage defined by the shoulder portion 7 of the skirt 5 and by the part 1, as far as the rupturable diaphragm 4. The action of breaking the line of weakening 8 means that the strap 13 is free to uncoil through 360° so that, as seen in FIG. 7, the block 9 and part 3 move as diagrammatically indicated by the arrow A and the part 3 is presented, held on the end of the strap but spaced from the passage, ready to act as an obturator for the passage, undergoing the motion indicated by arrow B in FIG. 8. The part 3 is pressed in until its large end lodges in the passage portion 24, where the shoulder portion 7 prevents withdrawal and where also the conical surface of the part 3 seats firmly on the conical chamfer 25 of the part 12, the angle of conicity of the two being the same. It is to be noted that the stem of the part 3 is almost completely below the level of the top of the shoulder portion 7, so it is not readily accessible. The force required to remove the part 3 from the passage is greater than that which can be sustained either by the snap fit of the stem into the recess 17 or by the shank 21 of the stem. If an attempt is made to remove the part 3 by the stem (which is the only portion available for the purpose), the shank will break. If the shank 21 is unbroken and the part 3 is lodged in the passage, it is certain that it has not been removed from that passage previously. The only possibly non-destructive way of dislodging it could be by levering out using the edge of the shoulder 7 as a fulcrum, which might destroy the part 2 or at least leave very gross indications of interference.

Clearly other forms of embodiment are possible within the invention. Most obviously, a stem on the block 9 may fit into an undercut recess in an obturator part such as part 3.

Figure 10:
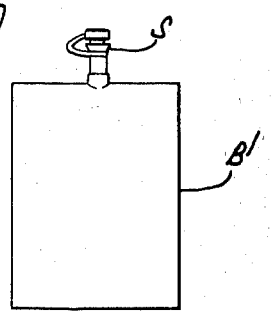

A blood bag B′ equipped with a tamper-proof seal as just described and here given the reference S, is seen in FIG. 10 of the drawings.

I claim:

1. A tamper-proof seal for an access opening to a container, consisting of a tube having an axial direction, a line of weakening around the said tube, an access passage defined by the tube at one axial side of the said line of weakening, an end wall, the end wall blanking off the tube at the axial side of the said line of weakening opposite to the said one axial side, a strap attaching the end wall to the tube portion defining the access passage, and an obturator, the obturator being attached to the said strap, the obturator comprising a tamper-proof seal for the access passage, whereby on destruction of the first said tamper-proof seal constituted by the line of weakening the access passage is revealed for re-sealing by the second said tamper-proof seal, the said second seal being arranged to indicate when it has been thereafter disturbed from its access denying position.

2. A tamper-proof seal for an access opening, including a first tamper-proof seal denying access to said opening until it has been destroyed and a second access-denying means to re-seal and deny access to the access opening made available on the destruction of the first seal, the second access-denying means being arranged to indicate when it has been thereafter disturbed from its access-denying position.

3. A tamper-proof seal according to claim 2 wherein the second said access-denying means is rendered available for resealing the access opening only by the action of destroying the first tamper-proof seal.

4. A tamper-proof seal according to claim 3 wherein the first tamper-proof seal is a line of weakening around a sealed tube having at one axial side of the line of weakening an access passage and at the other end a portion blanked off by an end wall whereby tearing off of the tube at the line of opening exposes the access passage for use, and the blanked off portion is attached by a strap to the portion providing the access passage, the strap bearing additionally an obturator for the access passage thus exposed, the strap and the obturator being attached to each other through a frangible link whereby after the obturator has been placed to deny access to the access passage an attempt to remove the obturator will cause rupture of the frangible link between the strap and the obturator.

5. A tamper-proof seal according to claim 4 wherein the line of weakening is in a region of the tube of a cross-section less than that of the access passage, and an annular shoulder between the said region and the access passage, the second access denying means being engageable behind the shoulder in its access denying position.

6. A tamper-proof seal according to claim 4 wherein the strap is attached at one side of the portion providing the access passage and passed through 360° over the blanked off portion to be attached to a side of the blanked off portion opposite the side of the access portion to which it was attached, the obturator being provided adjacent the end wall and at an axial face of its opposite to the axial face which blanks off the blanked-off portion at one axial side of the first tamper-proof seal, whereby the strap in unrolling after destruction of the first seal offers the obturator for presentation to the access passage.

7. A tamper-proof seal according to claim 6 wherein a lift tab is further attached to the blanked off portion.

8. A tamper-proof seal according to claim 4 wherein the strap has a ring in one end which is entrapped between an end portion of the blanked off portion at a side of the line of weakening nearer the access passage and an end portion of a tube forming the access passage.

9. A tamper-proof seal according to claim 4 wherein the strap includes an aperture adapted to receive and fit over a tapered said obturator.

10. A tamper-proof seal according to any one of the preceding claims further having a rupturable diaphragm in the access opening.

11. A tamper-proof seal according to claim 2 in combination with a container the said container having an access opening and the tamper-proof seal being positioned at the said access opening.

12. A container according to claim 11 which is a bag containing a member of the class comprising blood and blood products.

* * * * *